US008154835B2

(12) United States Patent
Di Maio et al.

(10) Patent No.: US 8,154,835 B2
(45) Date of Patent: Apr. 10, 2012

(54) POWER AND CONTROL UNIT FOR A LOW OR MEDIUM VOLTAGE APPARATUS

(75) Inventors: Luciano Di Maio, Milan (IT); Gabriele Valentino De Natale, Milan (IT)

(73) Assignee: ABB Technology AG, Zurich (CH)

( * ) Notice: Subject to any disclaimer, the term of this patent is extended or adjusted under 35 U.S.C. 154(b) by 162 days.

(21) Appl. No.: 12/511,532

(22) Filed: Jul. 29, 2009

(65) Prior Publication Data

US 2010/0027179 A1 Feb. 4, 2010

(30) Foreign Application Priority Data

Jul. 31, 2008 (EP) ..... 08161603

(51) Int. Cl.
*H02H 9/08* (2006.01)

(52) U.S. Cl. ..... 361/62; 361/42

(58) Field of Classification Search ..... 361/1, 42, 361/93.1, 62

See application file for complete search history.

(56) References Cited

U.S. PATENT DOCUMENTS 4,835,651 A * 5/1989 Li et al. ..... 361/68
6,426,856 B1 * 7/2002 Schneerson et al. ..... 361/79
2004/0252421 A1 12/2004 Knox et al.
2008/0157776 A1 7/2008 Jaffer et al.

OTHER PUBLICATIONS

Extended European Search Report, EP Application No. EP 08161603.9, dated Dec. 19, 2008.

* cited by examiner

*Primary Examiner* — Danny Nguyen
(74) *Attorney, Agent, or Firm* — Connolly Bove Lodge & Hutz LLP

(57) ABSTRACT

A power and control unit for low or medium voltage applications operatively coupable to a low or medium voltage apparatus and to a protection relay having a trip circuit supervision. The power and control unit for low or medium voltage applications according to the invention comprises:

a binary input which is operatively coupable with said protection relay;

a control unit operatively coupled to said binary input and operatively coupable to said low or medium voltage apparatus;

a failure and continuity detection unit operatively coupled to said binary input and that can be enabled and disabled;

an enabling unit operatively coupled to said failure and continuity detection unit and to said control unit and operatively coupable to said low or medium voltage apparatus.

22 Claims, 3 Drawing Sheets

POWER AND CONTROL UNIT FOR A LOW OR MEDIUM VOLTAGE APPARATUS

CROSS REFERENCE TO RELATED APPLICATIONS

This application claims priority to EP 08 161 603.9 filed Jul. 31, 2008, the entire contents of all are hereby incorporated by reference.

The present invention relates to a power and control unit for a low or medium voltage apparatus having improved features in terms of performances and functionality. The power and control unit of the invention is conveniently used in trip circuits of low or medium voltage apparatuses. For the purposes of the present application the term medium voltage is referred to applications in the range of between 1 and 50 kV and low voltage is referred to applications in the range below 1 kV.

Electronic devices for power and control purposes are conveniently used in low and medium voltage apparatuses (e.g., circuit breakers, contactors, disconnectors) to actuate said apparatuses. The power and control electronic devices generally include some binary inputs to acquire status information and receive remote opening and closing commands for the low or medium voltage apparatus.

These binary inputs are usually part of a trip circuit which comprises a protection relay which generates a trip command. The electronic devices then operates the apparatus according to said trip command. The binary inputs of the electronic devices for power and control purposes typically have also to interface the trip circuit supervision function which is available in the binary outputs of the protection relay.

The trip circuit supervision function is designed to check the continuity of apparatus controlled by the power and control electronic device (e.g. a coil) when the apparatus is not energized. Generally, it is able to detect an open circuit and generate an alarm indicating that the command chain is not working. Therefore the binary inputs should allow a minimum current to circulate during normal operation and the current circulation should be blocked to avoid the trip circuit supervision alarm.

A possible implementation already known in the art, consists in a power resistor connected in parallel to the binary input. However such a solution has a number of disadvantages and drawbacks.

As a first disadvantage, it can be mentioned that the power resistor is always connected in parallel to the binary input. When the binary input is driven with the high level control voltage, the power resistor generates high power that must be dissipated inside the power and control electronic device.

A further disadvantage derives from the fact that in order to reduce power consumption and thermal heating the value of the resistor is kept as high as possible. This generates some problems of interoperability with the trip circuit supervision function of some relay.

Still another disadvantage derives from the fact that this solution only allows to check the cable connection between the trip circuit supervision relay and the power and control electronic device and does not allow to detect failures in the power and control electronic device or in the low or medium voltage apparatus.

It is therefore an object of the present invention to provide a power and control unit for a low or medium voltage apparatus that solves the above-mentioned problems.

More in particular, it is an object of the present invention to provide a power and control unit for a low or medium voltage apparatus having improved performance in terms of failure and continuity detection functionalities.

As a further object, the present invention is aimed at providing a power and control unit for a low or medium voltage apparatus that is able to detect failures not only in the connection but also in the power and control unit itself, as well as in the low or medium voltage apparatus associated thereto.

Still another object of the present invention is to provide a power and control unit for a low or medium voltage apparatus that can be easily and effectively interfaced with trip circuit supervision relays.

Another object of the present invention is to provide a power and control unit for a low or medium voltage apparatus that allows to use standard switch contacts, instead of gold plated contacts, to control the binary inputs of the power and control unit.

Still another object of the present invention is to provide a power and control unit for a low or medium voltage apparatus that can be easily manufactured and at competitive costs.

Thus, the present invention relates to a power and control unit for low or medium voltage applications operatively coupable to a low or medium voltage apparatus and to a protection relay having a trip circuit supervision.

The power and control unit for low or medium voltage applications according to the invention comprises:

a binary input which is operatively coupable with said protection relay;

a control unit operatively coupled to said binary input and operatively coupable to said low or medium voltage apparatus;

a failure and continuity detection unit operatively coupled to said binary input and that can be enabled and disabled;

an enabling unit operatively coupled to said failure and continuity detection unit and to said control unit and operatively coupable to said low or medium voltage apparatus.

In a further aspect, the present invention relates to trip circuit for a low or medium voltage apparatus that comprises: a protection relay having a trip circuit supervision and a power and control unit having the above described features. In the trip circuit according to the invention, the binary input of said power and control unit are operatively connected to a binary output of said protection relay, while the power and control unit is operatively connected to said low or medium voltage apparatus.

In this way, it is possible to overcome some of the disadvantages and drawbacks of the electronic power and control unit, as well as of the trip circuits, of the known art. In particular the failure and continuity detection unit operatively associated to the binary input allows to perform a control of the continuity of the low or medium voltage apparatus connected to the power and control unit, as well as detect failures in the power and control unit itself.

Also, in the power and control unit for low or medium voltage applications according to the invention, power dissipation is limited, as better explained further on.

In addition, proper driving of the failure and continuity detection functionality allows to achieve the oxide burning feature, thereby making it possible to use standard switch contacts to control the binary inputs of the power and control unit.

Further characteristics and advantages of the invention will emerge from the description of preferred, but not exclusive, embodiments of the power and control unit for low or medium voltage applications according to the invention, non-limiting examples of which are provided in the attached drawings, wherein:

BRIEF DESCRIPTION OF THE DRAWINGS

With reference to FIG. 1, the power and control unit 1 for low or medium voltage applications according to the invention can be used in a trip circuit of a low or medium voltage apparatus 2 that includes a protection relay having a trip circuit supervision 3. Thus, power and control unit 1 is operatively coupable to said low or medium voltage apparatus 2 and to said protection relay with trip circuit supervision 3.

Figure 1:
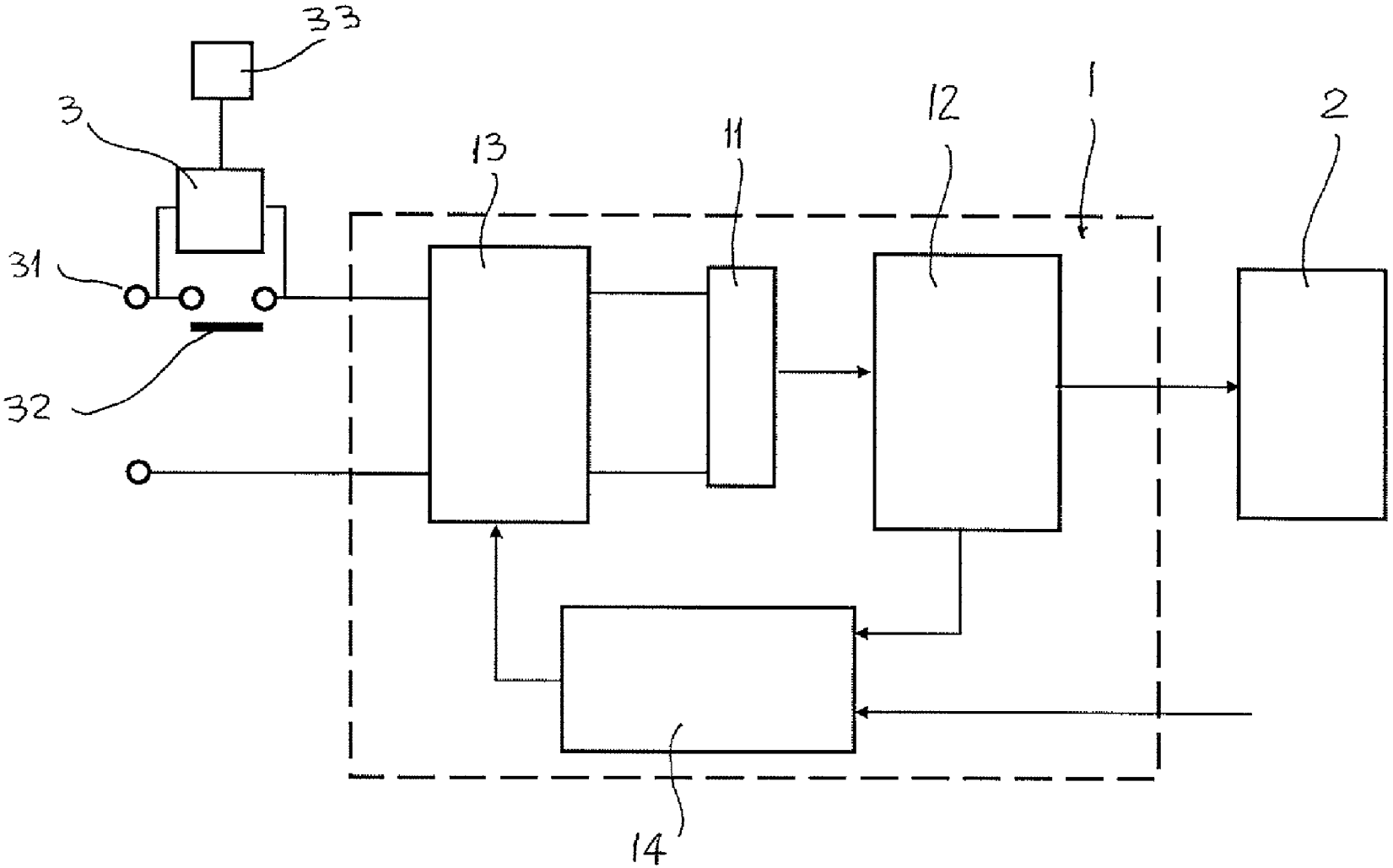
FIG. 1 is a block scheme of a general embodiment of the power and control unit and trip circuit according to the invention.

As shown in the attached figures, the power and control unit 1 of the invention generally comprises a binary input 11 operatively coupable with said protection relay; in particular, the binary inputs 11 can be interfaced with the trip circuit supervision function 3 available in a binary output 31 of the protection relay.

The power and control unit 1 of the invention also comprises a control unit 12 (e.g. a microcontroller) operatively coupled to said binary input 11 and operatively coupable to said low or medium voltage apparatus 2.

One of the characteristics of the power and control unit 1 of the invention resides in the fact that it comprises a failure and continuity detection functionality 13 operatively coupled to said binary input 11 that can be enabled and disabled. To this purpose, the power and control unit 1 also comprises an enabling unit 14 which is operatively coupled to the failure and continuity detection unit 13 as well as to said control unit 12 and which is operatively coupable to said low or medium voltage apparatus 2.

Figure 2:
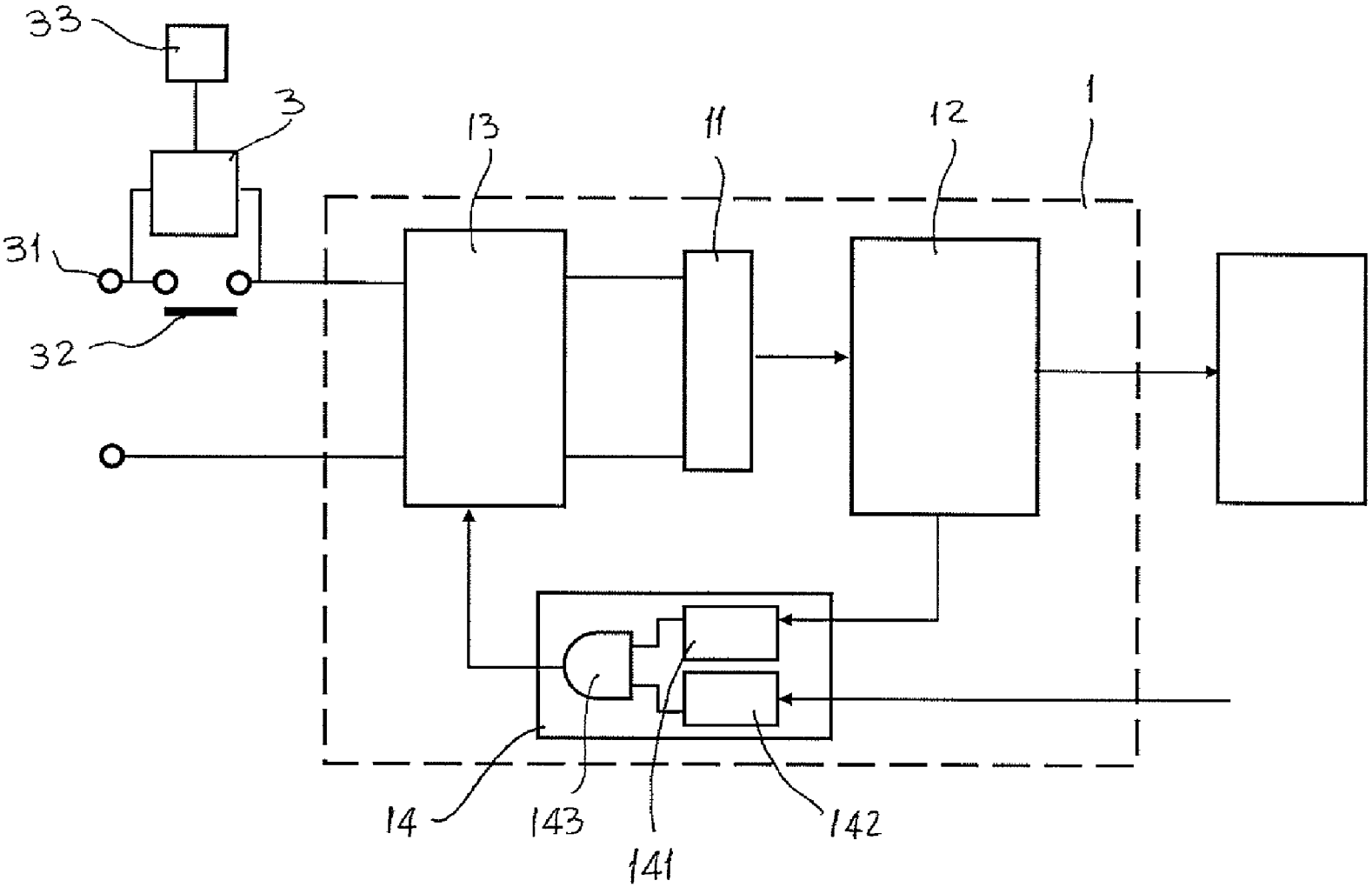
FIG. 2 is a block scheme of a first particular embodiment of the power and control unit and trip circuit according to the invention.

Preferably, as shown in FIG. 2, the enabling unit 14 is operatively coupled to an internal self diagnostic function 141 of said power and control unit 1 and is operatively coupable to an internal self diagnostic function 142 of said low or medium voltage apparatus. In other words, the enabling unit receives information concerning the diagnostic status of the power and control unit 1 and of the low or medium voltage apparatus and, based on said information, it can enable or disable the failure and continuity detection functionality 13.

To this purpose, said enabling unit 14 can conveniently comprise a logic port AND 143 whose inputs are connected to said internal self diagnostic function 141 of the power and control unit 1 and connectable to the internal self diagnostic function 142 of said low or medium voltage apparatus 2. In this way, in the event that a failure is detected by the self diagnostic functions 141 and 142, a proper signal can be sent to the failure and continuity detection functionality 13.

Figure 3:
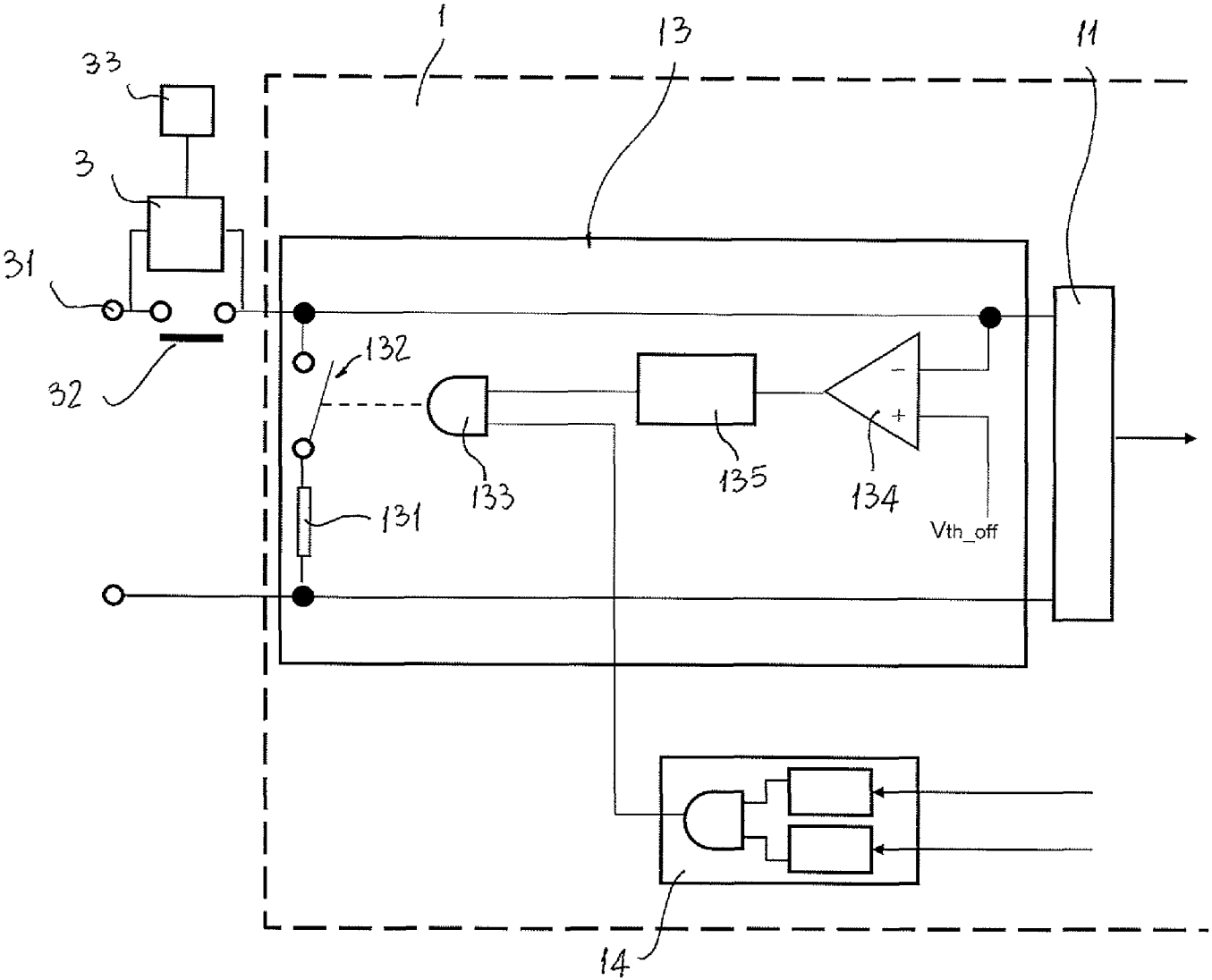
FIG. 3 is a block scheme of a second particular embodiment of the power and control unit and trip circuit according to the invention, including details concerning the circuit of failure and continuity detection unit.

As shown in FIG. 3, according to a preferred embodiment, the failure and continuity detection unit 13 comprises a low impedance load 131 (e.g. a resistor) that is connectable in parallel to said binary input 11 through a switch 132. Said switch 132 can be a solid state switch or an electromechanical switch.

Preferably, the switch 132 is driven in the ON or OFF position through a logic port AND 133. The inputs of the logic port AND 132 are connected to said enabling unit 14 and to a comparator 134, which in turn is connected to the input voltage Vin of said binary input 11.

The circuit of the failure and continuity detection unit 13 uses the input voltage Vin of the binary input 11 to discriminate a command sent to the binary input 11 to the current driven by the trip circuit supervision 3 relay. From a functional standpoint, the switch 132 is driven in the OFF position when the value of the input voltage Vin of said binary input 11 reaches a predetermined voltage threshold value Vth_off; similarly, the switch 132 is driven in the OFF position when the enabling unit 14 send a disabling signal as a consequence of a failure signal received from the self diagnostic functions 141 and 142.

According to a preferred embodiment of the power and control unit 1 of the invention, a delay line 135 is interposed between said comparator 134 and said logic port AND 133. This allows to accomplish the oxide burning feature that will be described further on.

A further alternative embodiment of the power and control unit 1 of the invention (not shown in the figures), foresees that the switch 132 is driven in the OFF position when the temperature of said low impedance load 131 increases above a predetermined threshold.

Alternatively, a current regulator can be used in place of the switch 132 controlled by the temperature of the load 131. This to regulate the power dissipation and keep the temperature of the load within a desired range.

The above described power and control unit 1 is conveniently part of a trip circuit of a low or medium voltage apparatus, which is also part of the present invention.

The trip circuit of the invention comprises a protection relay having a trip circuit supervision function 3. The trip circuit also comprises a power and control unit 1 whose binary input 11 are operatively connected to a binary output 31 of said protection relay. The said power and control unit is also operatively connected to said low or medium voltage apparatus 2.

In particular, said trip circuit supervision 3 is connectable in parallel to the binary output 31 of said protection relay through a switch 32, said trip circuit supervision 3 being also operatively connected to an alarm 33.

The trip circuit supervision 3 is normally designed to check the continuity of low impedance trip circuits, like solenoids and magnetic actuators of low or medium voltage apparatuses, when said circuit is not energized (i.e. the switch 32 is open). To this purpose, the trip circuit supervision 3 drives a small current (trip circuit supervision current Itcs), typically from a few mA to a few dozens of mA, in the trip circuit when the switch 32 is open. As a result, the voltage developed across solenoids and actuators when the trip circuit supervision 3 is active is within few volts and the power dissipated is very low.

Then, as already said, the circuit of the failure and continuity detection unit 13 uses the input voltage Vin of the binary input 11 to discriminate a command sent to the binary input 11 to the current driven by the trip circuit supervision 3 relay. Thus, the low impedance load 131 is connected in parallel to the binary input 11 only when the input voltage Vin is below a predetermined threshold Vth_off and the circuit of the failure and continuity detection unit 13 is enabled by the enabling unit 14. The power dissipation in the low impedance load 131 can be limited with the comparator 134 that disables the circuit by opening the switch 132 when the input voltage Vin reaches the threshold value Vth_off. Another way to limit the power dissipation in the low impedance load 131 is to switch off the circuit when the temperature of the load increases above a predetermined threshold.

Under operative conditions of the circuit of the failure and continuity detection unit 13 (i.e. when the load 131 is connected in parallel to the binary input 11) a continuous current is absorbed, and this current emulates the current circulating in the trip circuit under operative conditions and absorbed by, e.g., a shunt release coil. If the current cannot circulate, the trip circuit supervision 3 generates an alarm 33.

Thus, the failure and continuity detection unit 13 emulates a low impedance load only when it is required and it is disabled when the internal self diagnostic functions 141 and 142 detects a failure in the power and control unit 11 or in the low or medium voltage apparatus 2.

Normally, the trip circuit supervision current Itcs is the sum of a quiescent current Iq and a circuit supervision current Ics. The quiescent current Iq is the minimum current needed by the binary input 11 to stay active, while the circuit supervision current Ics is the current needed to perform a failure and continuity detection of said trip circuit. Under these conditions the trip circuit supervision functionality 3 generates an alarm 33 when said circuit supervision current Ics is interrupted.

The circuit used in the failure and continuity detection unit 13 also allows to perform the oxide burning feature, i.e. burn away the oxide from the not gold plated (i.e. conventional) contacts of the switch. To this purpose, a delay line 135 is associated with the comparator 134. This allows an appropriate delay time (e.g. 10 ms) to switch off the current after the input voltage has reached the threshold value Vth_off (or, it temperature control is used, after the temperature of the load has reached a predetermined threshold). An appropriate choice of the delay time, e.g. about 10 ms, allows burning the oxide on the not gold plated contacts.

It is clear from the above that the power and control unit 1 for low or medium voltage applications of the invention have a number of advantages with respect to similar units of known type.

In particular, the power and control unit 1 for low or medium voltage applications allows to implement failures and continuity detection not only in the connections but also in the power and control unit itself, as well as in the low or medium voltage apparatus associated thereto.

A further important advantage is that this functionality is implemented only when it is required and a permanently connected resistor with the related drawbacks, as in prior art devices, is no longer necessary.

The power and control unit of the invention can be easily interfaced with existing protection relay by properly matching the current working range of the trip circuit supervision unit with the minimum current needed to keep the unit active and the maximum current needed to perform the trip circuit supervision functions.

Also, since the unit can also the oxide burning feature, it is possible to use conventional switch contacts instead of gold paled contacts, with consequent savings in costs and maintaining the same performances.

The power and control unit of the invention finds convenient application in trip circuits of low and medium voltage apparatuses (e.g., circuit breakers, contactors, disconnectors, and similar), which are also part of the present invention.

The power and control unit for low and medium applications thus conceived may undergo numerous modifications, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A power and control unit for low or medium voltage applications operatively coupable to a low or medium voltage apparatus and to a protection relay having a trip circuit supervision, characterized in that it comprises a binary input operatively coupable with said protection relay, a control unit operatively coupled to said binary input and operatively coupable to said low or medium voltage apparatus, a failure and continuity detection unit operatively coupled to said binary input that can be enabled and disabled, an enabling unit operatively coupled to said failure and continuity detection unit, to said control unit and operatively coupable to said low or medium voltage apparatus, wherein said failure and continuity detection unit comprises a low impedance load that is connectable in parallel to said binary input through a switch or through a current regulator.

2. The power and control unit according to claim 1, characterized in that said enabling unit is operatively coupled to an internal self diagnostic function of said power and control unit and is operatively coupable to an internal self diagnostic function of said low or medium voltage apparatus.

3. The power and control unit according to claim 2, characterized in that said enabling unit comprises a logic port AND whose input are connected to said internal self diagnostic function of said power and control unit and connectable to said internal self diagnostic function of said low or medium voltage apparatus.

4. The power and control unit according to claim 1, characterized in that said switch is a solid state switch or an electromechanical switch.

5. The power and control unit according to claim 1, characterized in that said switch is driven in the ON or OFF position through a logic port AND.

6. The power and control unit according to claim 5, characterized in that the inputs of said logic port AND are connected to said enabling unit and to a comparator connected to the input voltage (Vin) of said binary input.

7. The power and control unit according to claim 5, characterized in that a delay line is interposed between said comparator and said logic port AND).

8. The power and control unit according to claim 1, characterized in that switch is driven in the OFF position when the value of the input voltage (Vin) of said binary input reaches a voltage threshold value (Vth_off).

9. The power and control unit according to claim 1, characterized in that switch is driven in the OFF position when the temperature of said low impedance load increases above a predetermined threshold.

10. A trip circuit for a low or medium voltage apparatus comprising a protection relay having a trip circuit supervision and a power and control unit according to claim 1, the binary input of said power and control unit being operatively connected to a binary output of said protection relay, said power and control unit being operatively connected to said low or medium voltage apparatus.

11. A trip circuit according to claim 10, characterized in that said trip circuit supervision is connectable in parallel to the binary output of said protection relay through a switch, said trip circuit supervision being operatively connected to an alarm.

12. A trip circuit according to claim 10, characterized in that said trip circuit supervision is activated when said switch is open.

13. A trip circuit according to claim 12, characterized in that when said trip circuit supervision is activated, it drives a trip circuit supervision current (Itcs) in said circuit.

14. A trip circuit according to claim 12, characterized in that said trip circuit supervision current (Itcs) is the sum of a quiescent current (Iq) and a circuit supervision current (Ics), said quiescent current (Iq) being the current needed by the binary input to stay active said and said circuit supervision current (Ics) being the current needed to perform a failure and continuity detection of said trip circuit, said trip circuit supervision generating an alarm when said circuit supervision current (Ics) is interrupted.

15. The power and control unit according to claim 2, characterized in that said failure and continuity detection unit comprises a low impedance load that is connectable in parallel to said binary input through a switch or through a current regulator.

16. The power and control unit according to claim 3, characterized in that said failure and continuity detection unit comprises a low impedance load that is connectable in parallel to said binary input through a switch or through a current regulator.

17. The power and control unit according to claim 4, characterized in that said switch is driven in the ON or OFF position through a logic port AND.

18. The power and control unit according to claim 4, characterized in that switch is driven in the OFF position when the value of the input voltage (Vin) of said binary input reaches a voltage threshold value (Vth_off).

19. The power and control unit according to claim 5, characterized in that switch is driven in the OFF position when the value of the input voltage (Vin) of said binary input reaches a voltage threshold value (Vth_off).

20. The power and control unit of claim 1, further comprising a first diagnostic unit that monitors a status of the power and control unit, and wherein said enabling unit enables and disables said failure and continuity detection unit based on at least the first diagnostic unit.

21. The power and control unit of claim 1, further comprising a second diagnostic unit that monitors a status of the power and control unit, and wherein said enabling unit enables and disables said failure and continuity detection unit based on at least the second diagnostic unit.

22. The power and control unit of claim 1, further comprising a first diagnostic unit that monitors a status of the power and control unit and a second diagnostic unit that monitors a status of the power and control unit, and wherein said enabling unit enables and disables said failure and continuity detection unit based on at least the first and second diagnostic units.

* * * * *